US006591726B1

(12) United States Patent
Perazzolo

(10) Patent No.: US 6,591,726 B1
(45) Date of Patent: Jul. 15, 2003

(54) ORIENTATION DEVICE FOR TURRET PUNCHING MACHINE

(75) Inventor: Eugenio Perazzolo, Rovigo (IT)

(73) Assignee: Rainer S.r.l., Claderara di Reno (IT)

( * ) Notice: Subject to any disclaimer, the term of this patent is extended or adjusted under 35 U.S.C. 154(b) by 0 days.

(21) Appl. No.: 09/116,651

(22) Filed: Jul. 16, 1998

(30) Foreign Application Priority Data

Jul. 16, 1997 (IT) ..... BO97A0432

(51) Int. Cl.[7] ..... B26F 1/04

(52) U.S. Cl. ..... 83/552; 83/556; 83/553; 83/551; 483/28; 483/29; 29/36; 29/43; 29/48.5 R

(58) Field of Search ..... 83/552, 685, 549, 83/551, 556; 483/28, 29; 29/36, 48.5 R, 48.5 A, 43

(56) References Cited

U.S. PATENT DOCUMENTS

| | | | | |
|---|---|---|---|---|
| 3,745,646 A | | 7/1973 | Kristiansson | 29/568 |
| 4,285,259 A | * | 8/1981 | Jelinek et al. | 83/552 |
| 4,412,469 A | * | 11/1983 | Hirata et al. | 83/552 |
| 4,696,211 A | * | 9/1987 | Bitzel | 83/49 |
| 5,346,454 A | | 9/1994 | Hayashi | 483/29 |
| 5,350,347 A | * | 9/1994 | Fujiwara et al. | 483/29 |
| 5,545,116 A | | 8/1996 | Seto | 483/29 |
| 6,200,246 B1 | * | 3/2001 | Perazzolo | 483/28 |

FOREIGN PATENT DOCUMENTS

| | | |
|---|---|---|
| DE | 3507220 | 3/1986 |
| JP | 5069058 | 3/1993 |

OTHER PUBLICATIONS

Derwent Abstract of DE 3507220 Dated Mar. 13, 1996.
Patent Abstracts of Japan of JP 5069058 Dated Mar. 23, 1993.

* cited by examiner

*Primary Examiner*—Peter Vo
*Assistant Examiner*—Minh Trinh
(74) *Attorney, Agent, or Firm*—Ladas & Parry

(57) ABSTRACT

A orientation device including two turrets, carrying a plurality of punch-die pairs, are rotatable to carry a punch-die pair to a work station and, simultaneously, another punch-die pair to a changeover station. A magazine of punch-die pairs comprises at least one pair of discs joined to each other and carrying a series of punch-die pairs. The discs are selectively rotated to take a predetermined new punch-die pair to a collection station. At least one exchange arm is rotated by a corresponding servomotor and carries at least one gripper element, axially and radially moveable with respect to the arm, independently of each other.

4 Claims, 6 Drawing Sheets

Fig.5
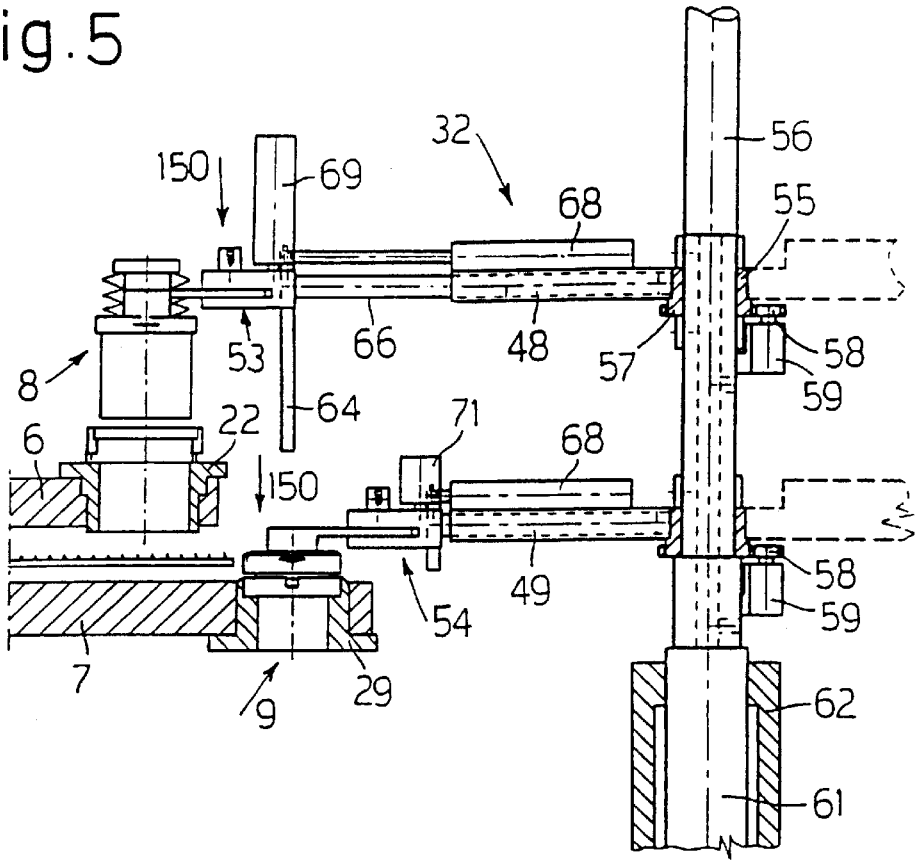
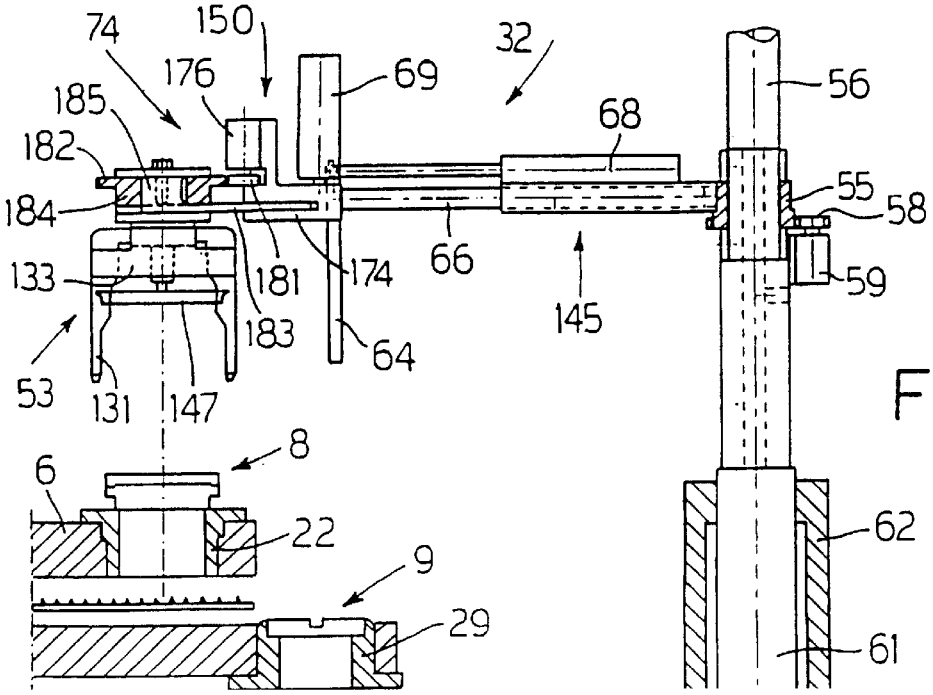
Fig.6

Fig. 7
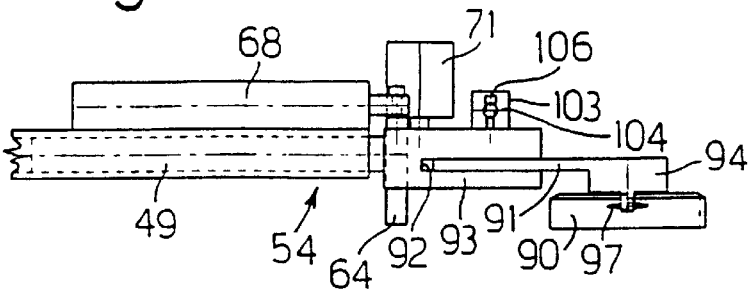
Fig. 9
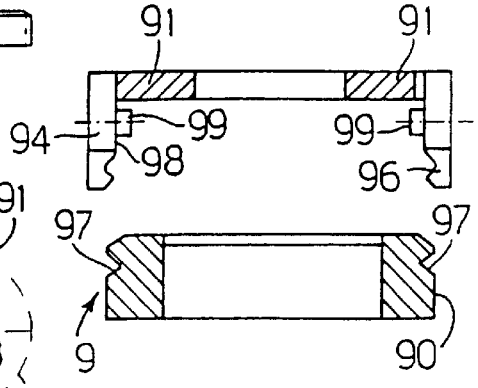
Fig. 8
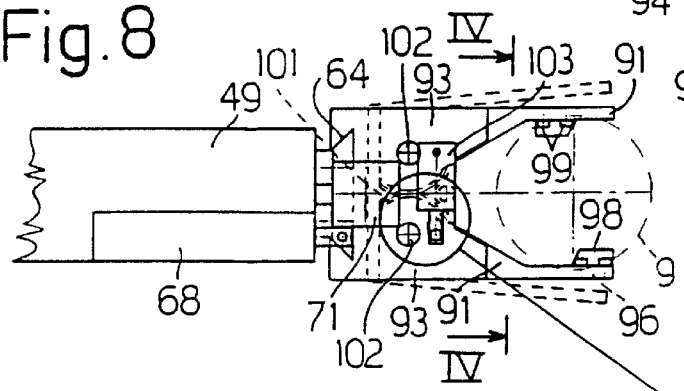
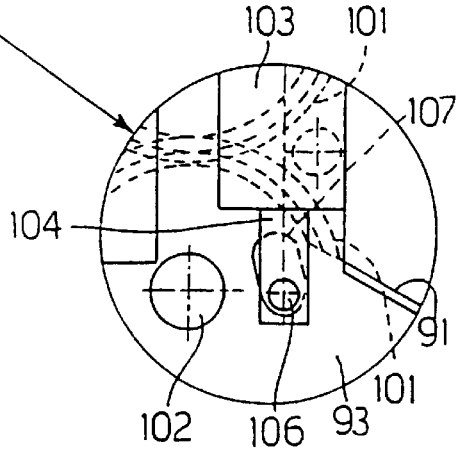
Fig. 8a
Fig. 10
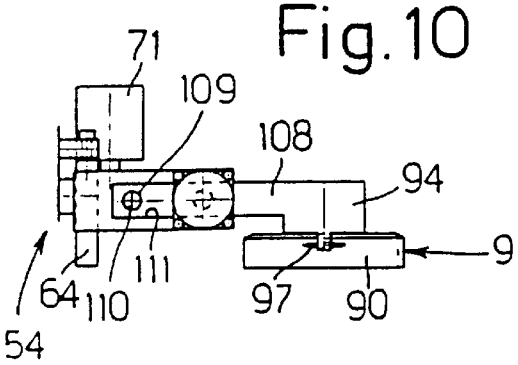
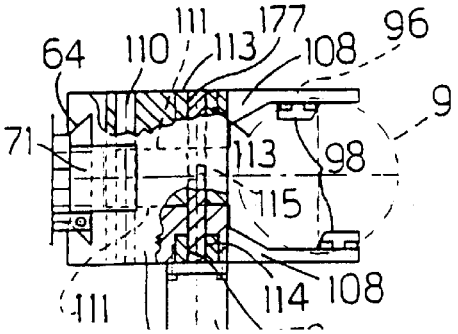
Fig. 11

ORIENTATION DEVICE FOR TURRET PUNCHING MACHINE

BACKGROUND OF THE INVENTION

The present invention concerns a turret punching machine. In particular, the invention concerns a sheet metal punching machine comprising a pair of turrets carrying a plurality of punch and die pairs.

As is known, in turret punching machines, the two turrets are rotatable in order to carry a predetermined punch-die pair to a work station, in vertical alignment with a hammer which acts on the punch. Usually, the two turrets are coaxial and of equal diameter, and have a limited number of punch-die pairs. Consequently, if a working cycle requires a greater number of such pairs, the operator must stop the machine after part of the required punching has been done in order to replace the punch-die pairs already used with other punch-die pairs.

It is clear that stopping the machine and the necessity of using labour to replace the punches and dies increase the processing costs. Furthermore, the machines described cannot be utilised during those work shifts, for example, at night or on holidays time, when the availability of labour is scarce.

Turret punching machines have been proposed in which the two turrets are mounted on two offset axes in order to obtain a zone, substantially opposite the work station, where the two turrets are not superimposed. In this case, the punches and dies can be changed over even during the working.

A punching machine is also known from U.S. Pat. No. 5,346,454 in which the upper turret of the punches has a smaller diameter than the lower turret of the dies, so as to obtain a station for the changeover of the punch-die pair where the upper turret does not cover the lower turret. The machine also has a magazine of punch-die pairs, formed from a pair of rotatable discs fixed to each other and carrying the punches and the dies respectively.

The punch-die pair of the changeover station of the turrets is replaced with a pair carried by the discs by means of a pair of simultaneously rotatable arms which rotate by at 180° each time. These arms carry a pair of gripper elements at their two ends, for the punches and the dies respectively, which elements are moveable parallel to the axis of the turrets in order to insert the punches and dies in the respective seats.

In an embodiment of this machine, the two discs have complementary diameters to those of the turrets, while the two arms are of fixed length. In another embodiment, the discs are of equal diameter, but the arm for changing over the punches is extensible in order to compensate for the greater distance of the punches on the disc from the axis of rotation of the arm, with respect to those of the turret. Finally, each gripping element is constituted by simple leaf springs carried on the two arms.

This machine has various disadvantages. In particular, it does not enable the automatic changeover of the punches and the dies where the shape of the magazine or the turrets require a different rotation for the two arms, or for the variation in length of both arms. In addition, the magazine is very cumbersome, even for a limited number of punch-die pairs, since they are only located on the two discs. Finally, the gripper element formed from leaf springs is fairly unreliable.

SUMMARY OF THE INVENTION

The object of the invention is to produce a turret punching machine which exhibits the maximum simplicity and safety of operation, and which eliminates the disadvantages described above in relation to the known punching machines.

This object is achieved by the turret punching machine according to the invention, which includes a changeover station for the punch and the die, a magazine having a pair of supports for a series of punch-die pairs, selection means for bringing a predetermined punch-die pair to a collection station, and a pair of changeover elements associated with the said supports for replacing the punch-die pair of the said stations, and which is characterised in that each of the said changeover elements is provided with corresponding displacement means operable to move the said changeover elements selectively and/or independently of each other with respect to the said stations.

BRIEF DESCRIPTION OF THE DRAWINGS

For a better understanding of the invention, several embodiments will now be described, given by way of non-limitative example with reference to the accompanying drawings, in which:

FIG. 5 is a partial vertical section of another embodiment of the invention;

FIG. 6 is a partial vertical section of another embodiment of the invention;

FIG. 7 is a side view on an enlarged scale of a gripper element of the machine of FIGS. 1 and 5;

FIG. 8 is a view from above of the gripper element of FIG. 7;

FIG. 8*a* is a detail of FIG. 8 on an enlarged scale;

FIG. 9 is a section taken on the line IX—IX of FIG. 8, on an enlarged scale;

FIG. 10 is a side view of a variant of the gripper element of FIG. 7;

FIG. 11 is a view from above, partially in section, of the gripper element of FIG. 10;

DETAILED DESCRIPTION OF THE INVENTION

General Description

Figure 1:
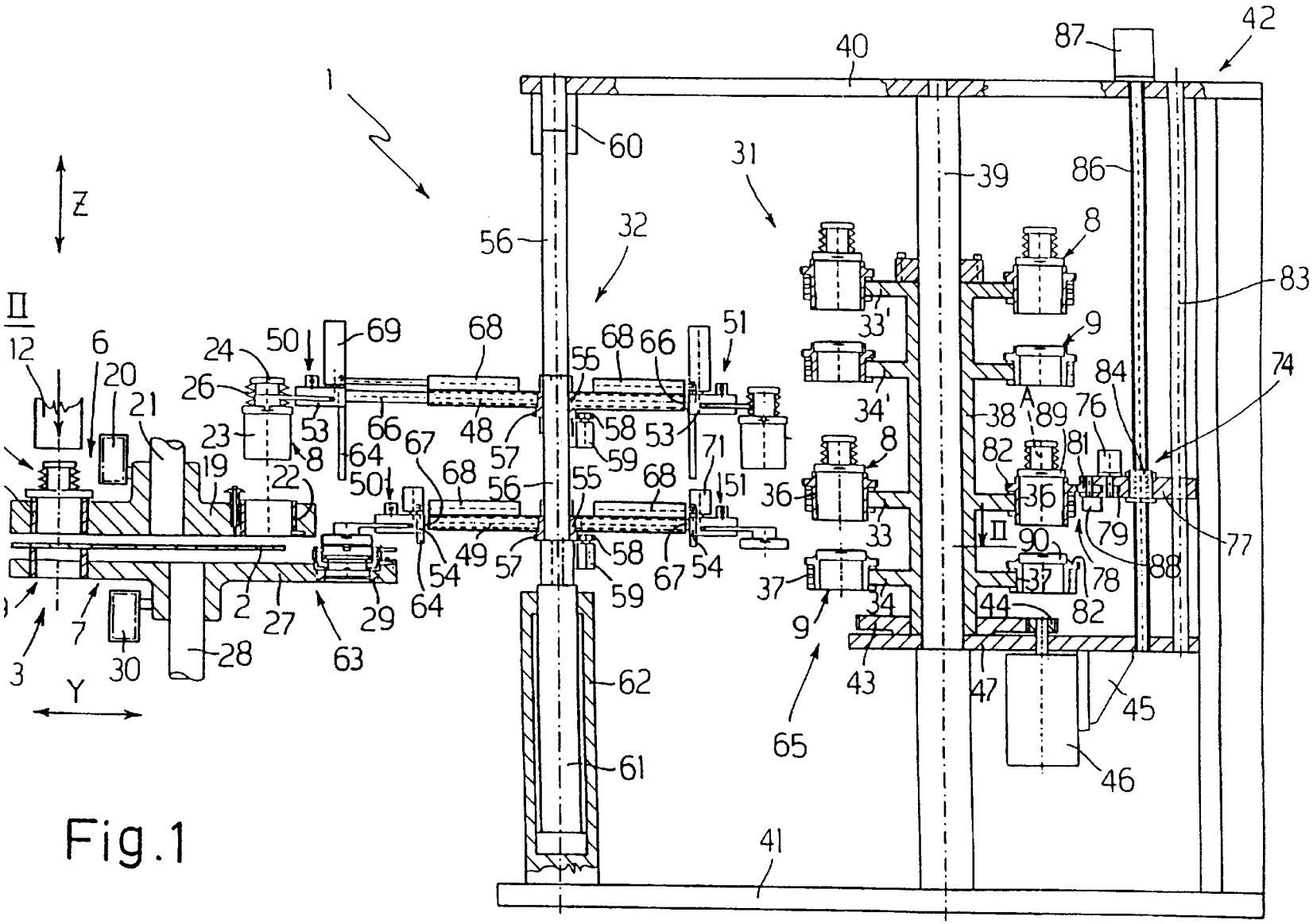
FIG. 1 is a vertical schematic section of a punching machine according to a first embodiment of the invention.
Figure 2:
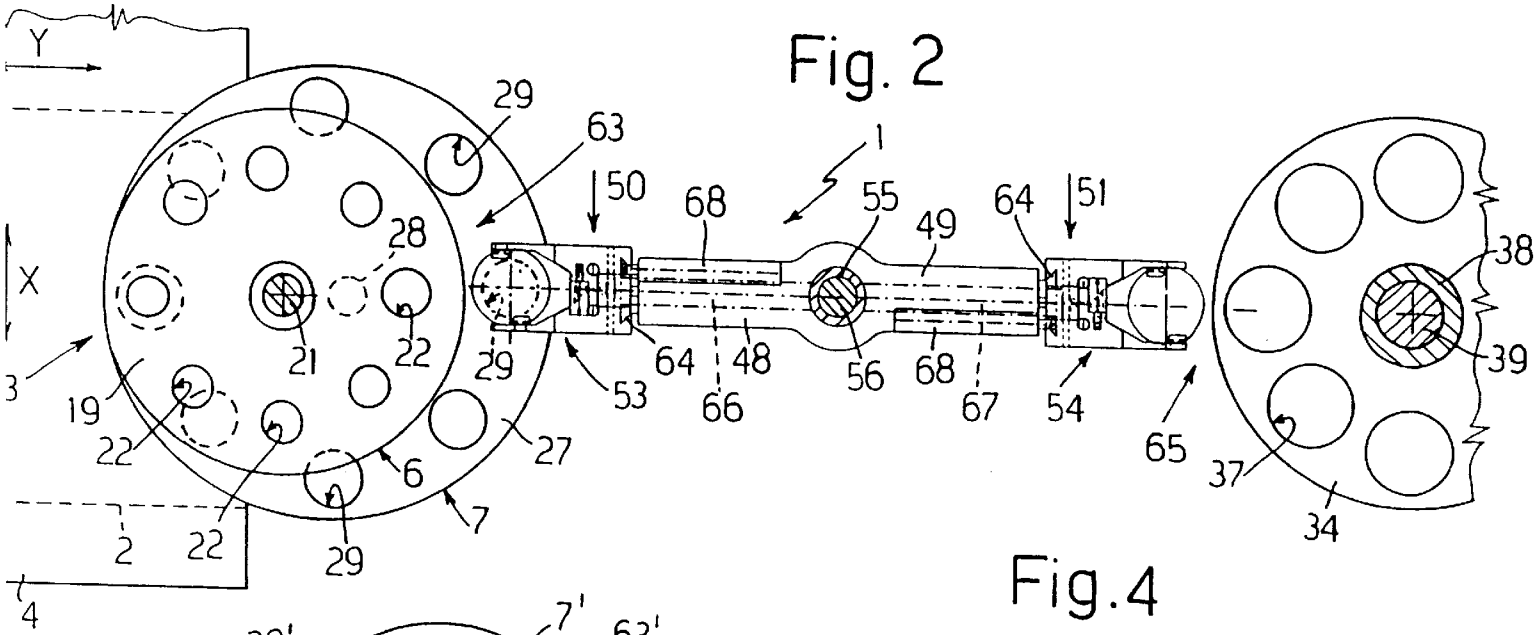
FIG. 2 is a partial section taken on the line II—II of FIG. 1.

With reference to FIGS. 1 and 2, the reference numeral 1 generally indicates a punching machine for working sheet metal 2, indicated in broken outline in FIG. 2. The machine comprises essentially a work station 3 and a horizontal work surface 4 which supports the sheet 2 in its movement with respect to the work station 3. This movement is effected along a pair of co-ordinate axes X, Y.

In particular, the punching machine 1 is of the turret type, and includes a pair of superimposed turrets 6 and 7 which carry a plurality of punch and die pairs 8, 9. The upper turret 6 carries a plurality of punches 8 while the lower turret 7 carries a corresponding plurality of dies 9. The turrets 6 and 7 are selectively rotatable to select the punch-die pair 8, 9 to bring to the work station 3, in which a hammer 12 moves along a co-ordinate axis Z to engage the punch 8 in order to punch a hole in the sheet metal 2.

In particular, the turret 6 is formed from a disc 19 selectively rotatable on a shaft 21 by means of a servomotor 20. Along a peripheral rim of the disc 19 is a plurality of seats for housing the punches 8, each formed from a sleeve 22. Each punch 8 is formed from a punch holder 23 insertable into the sleeve 22, and a punch tool 24 which is axially slidable to a certain extent into the holder 23 against the action of a spring 26. Similarly, the turret 7 is formed from a disc 27 selectively rotatable on a shaft 28 by a servomotor 30, and has a plurality of seats along a peripheral rim for housing the dies 9, each formed from a sleeve 29.

A Changeover Device for the Punch-Die Pair

According to the invention, the machine 1 has a magazine 31 for a series of punch-die pairs 8, 9, and a device 32 for changing over these pairs between the turrets 6, 7 and the magazine 31. The magazine 31 comprises at least a pair of supports 33, 34, of which the upper support 33 has a series of seats 36, each capable of accommodating a punch 8, while the lower support 34 has a corresponding series of seats 37, each capable of accommodating a die 9.

In particular, the magazine 31 comprises two pairs of supports in the form of pairs of discs 33, 34 and 33', 34', all of which have the same diameter and are fixed to a hollow shaft 38 rotatable about a vertical shaft 39 fixed to two plates 40 and 41 of a fixed frame 42. A toothed wheel 43 is also fixed to the hollow shaft 38, which wheel 43 is in engagement with a pinion 44 of a servomotor 46 carried by a bracket 45 fixed to another plate 47 of the frame 42.

The changeover device 32 for the punch-die pairs 8, 9 comprises a pair of changeover elements associated with the turrets 6, 7 and moveable to replace a punch-die pair 8, 9 of the turrets 6, 7 with a punch-die pair 8, 9 of one of the pairs of discs 33, 34 or 33', 34'. According to the embodiment of FIGS. 1 and 2, these changeover elements are formed from two so-called double arms 48, 49, which are the same as each other. The arms 48, 49 are pivoted at the centre point and each have two ends 50 and 51. The ends 50, 51 of the arm 48 have two gripper elements 53 for the punches 8, while the ends 50, 51 of the arm 49 have two gripper elements 54 for the dies 9.

In particular, each of the two arms 48 and 49 is fixed to a corresponding sleeve 55 which is angularly rotatable, but not axially moveable, on a common vertical guide in the form of a cylindrical rod 56. Each sleeve 55 is fixed to a corresponding toothed wheel 57 in engagement with a pinion 58 of a corresponding reversible servomotor 59 carried on the rod 56. The rod 56 is guided by a sleeve 60 fixed to the plate 40, and is moved by a pneumatic actuator. In particular, the rod 56 is fixed to a piston 61 of a pneumatic cylinder 62.

According to a first embodiment of the invention, the disc 19 of the upper turret 6 has a smaller diameter than the disc 27 of the lower turret 7. The two turrets 6 and 7 are therefore rotatable on the shafts 21 and 28 having offset axes. Therefore, the upper turret 6 does not cover the seats 29 of the lower turret 7 in a zone opposite the work station 3.

The two seats 22 and 29 of the discs 19 and 27, diametrically opposed to those from time to time in the work station 3, are located in two positions which constitute a changeover station 63 for the punch-die pair 8, 9. At rest, one of the two gripper elements 53, 54 of the two arms 48, 49 is located at the changeover station 63.

According to a characteristic of the invention, each gripper element 53, 54 is slidable on the corresponding arm 48, 49, both radially and axially with respect to the axis of the rod 56. In particular, each gripper element 53, 54 is axially slidable on a dove-tailed guide 64 carried on a rod 66, 67 of each arm 48, 49.

Advantageously, the rods 66, 67 are telescopically moveable with respect to the related arm 48, 49 by means of a corresponding actuator or pneumatic cylinder 68. The axis of the rod 56 is disposed at the same distance from the seat 22 of the punch 8 on the turret 6 in the changeover station 63 as from the seat 36 of the punch 8 on the disc 33 in a collection station 65 located on the plane of the axes of the shaft 39 and the rod 56.

In turn, the gripper elements 53, 54 are moveable along the corresponding guides 64 by means of corresponding actuators or pneumatic cylinders 69, 71, respectively, in order to insert and remove the punches 8 and dies 9 with respect to the respective seats 22, 29 and 36 and 37. The stroke of the actuators 71 for the gripper elements 54 of the arm 49 is less than that of the actuators 71 for the gripper elements 53 of the arm 48 due to each die 9 being lower than the punch 8.

The servomotors 20, 30, 46, 59 and the pneumatic cylinders 61, 68, 69 and 71 are controlled by a programmable control unit, in a known way.

The changeover device for the punch-die pair of the punching machine operates as described below.

At rest, the pneumatic cylinders 68 hold the rods 68 and 67 retracted in the respective arms 48 and 49, which are held by the cylinder 61 at a slightly higher level than the two turrets 6 and 7. At the start of a cycle for changing over the punch-die pair 8, 9, the servomotors 20 and 30 rotate the discs 19 and 27 (FIG. 2) of the turrets 6 and 7 in such a way as to bring the punch-die pair 8, 9 to be exchanged to the changeover station 63.

The rotation of the discs 19, 27, in order to select the punch-die pair 8, 9 to be changed, can be the same rotation needed to bring another punch-die pair 8, 9 to the work station 3, so that the changeover of the punch-die pair 8, 9 can be effected during the punching by the pair in the work station 3. To this end, the pair to be changed can advantageously be located in the seats 22 and 29 of the discs 19 and 27, diametrically opposite those of the punch-die pair 8, 9 effecting the punching.

The gripper element 54 of the end 50 of the arm 49 is thus located at the die 9 to be exchanged. The cylinder 68 of the end 50 of the arm 48 is now operated, which causes the related gripper element 53 to move radially, carrying it in correspondence with the punch 8 to be changed. Simultaneously, the servomotor 46 is rotated to carry the magazine 31, together with the punch-die pair 8, 9 for collection, to the collection station 65 of the new punch-die pair 8, 9.

The two pneumatic cylinders 69 and 71 of the end 50 are then operated to engage the gripper elements 53 and 54 on the punch 8 and die 9 to be changed over on the turrets 6 and 7. The two pneumatic cylinders 69 and 71 of the ends 50 are thus operated to remove the engaged punch-die pair 8, 9 from the seats 22 and 29.

Therefore, the cylinder 62 is operated, which causes the piston 61 to move selectively upwards, in such a way as to take the arms 48 and 49 axially to the level of the pair of discs 33–34, 33'–34' where the new punch-die pair 8, 9 to be collected is located. Obviously, if the punch-die pair 8, 9 to be collected is located in the pair of discs 33, 34, this axial movement is not necessary.

The pneumatic cylinders 68 of the ends 51 of the two arms 48 and 49 are now operated to take the respective gripper elements 53 and 54 to engage respectively the punch 8 and the die 9 to be collected for the changeover. The two cylinders 69 and 71 of the ends 51 are then operated, initially to engage and then to remove the new punch-die pair 8, 9 from the seats 36 and 37, analogously to that seen for the punch-die pair 8, 9 of the turrets 6 and 7.

The two servomotors 59 are now operated so as to rotate the two arms 48 and 49 by 180°, carrying the punch-die pair 8, 9 to be changed over to the seats 36 and 37 of the magazine 31 from which the new punch-die pair 8, 9 has been collected. The new punch-die pair 8, 9 is thus carried to the two seats 36, 37 that are now empty. The cylinder 68 of the end 50 of the arm 49 is now operated to align vertically the collected die 9 with the related punch 8. Then, the pneumatic cylinders 69, 71 of the ends 50 are again operated to insert the collected punch-die pair 8, 9 in the two seats 36 and 37.

The two pistons 68 of the ends 50 are then operated in order radially to withdraw the related gripper elements 53 and 54, and the piston 68 of the end 51 is operated to carry the collected die 9 to the vertical level of the seat 29 of the turret 7 in which it is to be inserted. If necessary, the cylinder 62 is then operated to return the arms 48 and 49 to the level of the discs 19 and 27 of the turrets 6, 7. Finally, the two cylinders 69 and 71 are operated, initially to move the gripper elements 53 and 54 downwards, inserting the new punch-die pair 8, 9 into the seats 22 and 29 of the turrets 6 and 7, and then to return these gripper elements 53, 54 to the rest position of FIG. 1.

Figure 3:
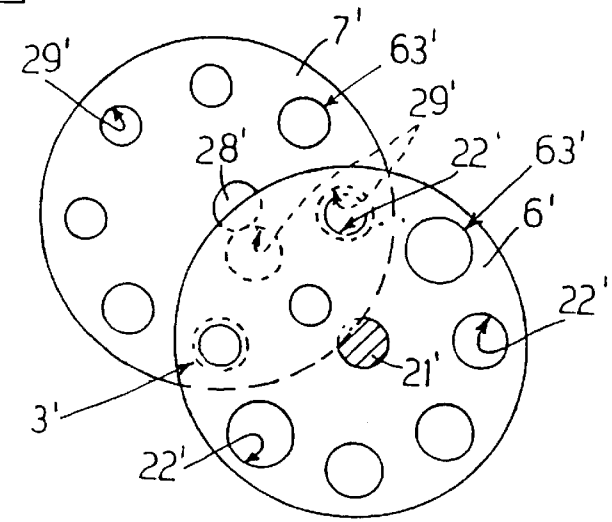
FIG. 3 is a detail of FIG. 2 according to another embodiment of the invention.

According to the embodiment of FIG. 3, in which the components that are the same as in FIG. 2 are indicated using the same reference numerals provided with an apostrophe, the two turrets 6' and 7' have the relatively offset shafts 21' and 28', but have the same diameter. The work station 3' is located in one of the two positions in which the seats 22' and 29' of the punch 8 and the die 9 are vertically aligned.

The changeover station 63' for the punch-die pair 8, 9 is located at two different angular positions with respect to the shafts 21', 28' such that the seat 29' of the die 9 remains uncovered by the turret 6'. Advantageously, the changeover station 63' can be chosen on the position of the first seat 29 for the die 9, adjacent the two aligned seats 22', 29', but away from the work station 3' and the corresponding seat 22' of the turret 6'.

In this embodiment, the two changeover arms can have their ends at an angle to each other, such that from one side the two ends are aligned with the collection station, and from the other they are aligned with the positions of the changeover station 63'. In order to insert and remove the punch-die pairs 8, 9 from the turrets 6', 7' and the magazine, the two arms are rotated by the respective servomotors at different angles and/or in different directions.

Figure 4:
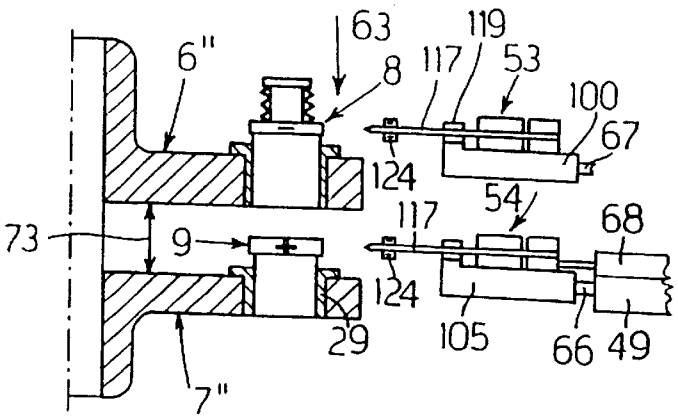
FIG. 4 is a partial vertical section of another embodiment of the invention.

According to the embodiment of FIG. 4, the two turrets 6", 7" can have the same diameter and be coaxial provided the space 73 between the two turrets is sufficient to enable the insertion and removal of a die 9 in the related seat 29 by means of the transverse movement of the gripper element 54, as indicated in FIG. 4.

In this case, the rods 66 and 67 of the related arms 48 and 49 are fixed to two corresponding supports 100 and 105 to which the gripper elements 53 and 54 are fixed. However, at least the gripper element 54 of the die 9 must be disengaged in order to reduce its vertical dimension to the minimum. The operation of the cylinders 68 of the arm 49 can then be used to move the die 9 transversely into the space 73.

According to the embodiment of FIG. 5, the changeover device 32 comprises two so-called simple arms 48, 49, each having a single end 150 provided with the gripper element 53, 54. The other end of each arm 48, 49 is instead fixed to the corresponding sleeve 55 which is rotated by the related servomotor 59.

For the changeover of the pair 8, 9, the two simple arms 48, 49 first remove the punch-die pair 8, 9 from the turrets 6 and 7, in an analogous way to that seen above.

Then, the two arms 48, 49 are rotated by 180° to bring them into the position indicated in broken outline in FIG. 5, where the punch 8 and the die 9 are inserted into the seats 36 and 37 (FIG. 1) of the magazine 31.

Subsequently, the angular movement of the magazine 31 and/or the axial movement of the rod 56 together with the arms 48, 49 is effected to select the new punch-die pair 8, 9 to be collected. Finally, the arms 48, 49 remove the new punch-die pair 8, 9 from the magazine, they are rotated in order to bring them to the position of FIG. 5, and insert the new punch-die pair 8, 9 into the seats 22, 29 of the turrets 6, 7 in a way analogous to that seen above.

According to the embodiment of FIG. 6, the changeover device 32 is constituted by a single, so-called simple arm 145 having a single end 150 provided with a gripper element 53, while the other end is fixed to the sleeve 55. The arm 145 and the single gripper element 53 now first of all exchange the punch 8 between the turret 6 and the magazine 31, and then exchange the related die 9. In this case, the magazine 31 can be constituted by a single pair of discs 33, 34, while the axial movement of the arm 145 controlled by the cylinder 62 is used to move alternatively between the turret 6 and the turret 7.

From that seen above, the advantages of the punching machine according to the invention with respect to the known machines are clear. Above all, the possibility of varying the length of both of the arms 48, 49 introduces a wide choice to the form and disposition of the magazine 31, the changeover device 32 and the pair of turrets 6, 7.

Furthermore, the independent rotation of the two arms 48, 49 enables the automatic changeover of the punches 8 and the dies 9 where the form of the magazine 31 or of the turrets 6, 7 requires a very different rotation for the two arms 48, 49. Finally, the possibility of axially moving the arms 48 and 49 enables a magazine 31 having a plurality of disc pairs 33, 34; 33' 34', thus reducing the space taken up thereby.

It is understood that various other modifications and improvements can be introduced into the punching machine described without by this departing from the ambit of protection of the claims. For example, in the magazine 31, the disc 33, 33' for the punches 8 can have a different diameter from the disc 34, 34' for the dies 9. Furthermore, the magazine 31 can be formed from pairs of different supports, such as pairs of plates or racks, that are selectively moveable in one or more co-ordinate directions, or pairs of flexible transport elements that are moveable along closed paths, etc.

In turn, the changeover arms 48, 49 can be moved axially along different paths by means of separate actuators. In addition, at rest, the changeover arms 48, 49 can be disposed in an intermediate position between the two insertion positions of the punch-die pairs 8, 9 in the magazine 31 and the turrets 6, 7. The changeover arms 48, 49 can also be replaced by different means for the changeover, such as guides or trolleys.

Finally, the collection station of the punch-die pairs 8, 9 to be changed over can be provided in an intermediate position, away from the magazine 31. In this way, the new punch-die pair can be transferred in advance to the intermediate position, and the used punch-die pair returned to the magazine 31 using different means from the changeover means.

A Device for Orientating the Punch and/or the Die

The punching machine 1 is provided with a device generally indicated 74 (e.g., FIGS. 1 and 6) for orienting a punch 8 and/or die 9. The orienting device is operated when at least one of the punches and dies requires orientation about its longitudinal axis A. This orientation can be required, for example, in order to punch more than once with the same punch or die when, in successive punching, the punch or die must assume different relative angular positions, or the angular position of the punch and/or die must be different from that of its first punching.

According to the invention, the orientation device 74 is associated with the magazine 31, and comprises a reversible servomotor 76 carried by an element or support 77 outside the magazine 31, in an orientation station 78. The servomotor 76 is able selectively to rotate a pinion 79 having straight teeth which, by means of a toothed guiding wheel 81, is engagable with a toothed rim 82 having straight teeth, together with each of the sleeves 36 of the punches and/or 37 the dies 9.

Advantageously, in the embodiment of FIGS. 1 and 2 in which the magazine 31 is constituted by a series of pairs of discs 33, 34, the orientation station 78 can be diametrically opposite from the collection station 65. The support 77 is slidable on a guide bar 83 parallel to the shaft 88. The bar 83 can be cylindrical or prismatic, and is fixed to the plates 40 and 47. In addition, to the support 77 is fixed a nut 84, for example, spherical, in engagement with a screw 86 parallel to the bar 83 and rotatable on the two plates 41 and 47. The screw 86 is rotated selectively by a reversible servomotor 87 carried by the plate 40.

Finally, a decoder 88, known in itself, is fixed to the base of the support 77 for reading an identification code located on the seat 36, 37 of the punch 8 and the die 9, for example, a common bar code. Alternatively, the bar code can be on a flange 89 of the punch 8 and a flange 90 of the die 9. In this case, the support 77 is located beforehand in an axial reading position corresponding to each disc 33, 33' and 34, 34', and is subsequently axially moved to engage the toothed ring 82.

Whenever the orientation of a punch 8 and/or the related die 9 is required, after the punch-die pair 8, 9 has been returned to the seats 36 and 37 of the magazine 31, the device 74 effects an orientation cycle. It is envisaged that a punch 8 of the disc 33 must be rotated, as indicated in FIG. 1. First of all, the servomotor 87 is rotated in one of the two directions in order to bring the support 77 into the reading position corresponding to the disc 33, if it is not already there. The servomotor 87, by means of the screw 86 and the nut 84, moves the support 77 along the bar 83, bringing the reader 88 to the level of the bar code of the punches 8 or the seats 36 on the disc 33. The servomotor 46 is then rotated to carry the punches 8 of the disc 37 sequentially in front of the reader 88.

When the reader 88 reads the code of the punch 8, the servomotor 48 is automatically stopped. Then, if the bar code is on the flange 89, the servomotor 87 lowers the support 77 which now carries the guide wheel 81 to engage with the toothed rim 82 of the seat 36 of the chosen punch 8. The servomotor 76 is now rotated in the direction required for orientation and, by means of the pinion 79 and the wheel 81, rotates the toothed wheel 82 together with the punch 8 about the longitudinal axis A of the punch.

Finally, the servomotor 87 moves the support 77 vertically in order to disengage the wheel 81 from the toothed rim 82 so that the shaft 38 can be rotated for a changeover cycle of the punch-die pair 8, 9. If the orientation of the die is required, the orientation cycle is effected analogously to that seen for the punch 8, so that it is not described below.

In the embodiment of FIG. 6, the orientation device 74 is advantageously located on the single arm. 145. To this end, the bar 66 of the arm 145 is fixed on a support 174 carrying a reversible servomotor 176. This is provided with a pinion 181 in engagement with a toothed rim 182 of a sleeve 184 in which a handle 185 for the gripper element 53 is fixed. The support 174 also carries a plate 183 in which the sleeve 184 is rotatably mounted. In this way, a single orientation device 74 is sufficient to orientate both the punch 8 and the die 9, for example, during the rotation of the arm 145 for the transfer between the turrets 6, 7 and the magazine 31.

It is clear that the orientation device 74 described has the advantage of having a very simple structure, and of not complicating the construction of the turrets 6, 7. In addition, it is able to orientate both the punch 8 and the die 9, even during the punching operations of other punch-die pairs 8, 9. Finally, the sensor 88 enables the automatic location of the punch 8 or the die 9 to be orientated.

It is clear that various modifications and improvements may be introduced to the orientation device described without by this departing from the ambit of the claims. For example, the orientation station 78 may be in different positions from those diametrically opposite the collection station 65. In addition, where a magazine 31 is formed from plates moveable along at least one displacement axis, locating the punch 8 to be orientated can be effected by moving the orientation device 74 parallel to this displacement axis. Finally, the sensor 88 can also be used to select the punch-die pair 89 to be collected for the changeover cycle with that of the turrets 6, 7.

A Transversely Moveable Gripper Element for the Punch and the Die

According to a first embodiment of the gripper elements 53, 54, they are transversely moveable with respect to the punch 8 and the die 9. In particular, the gripper elements 53 and 54 are the same as each other and are in the form of a pair of jaws 91. In FIGS. 7–11, the gripper element 54 of the die 9 is represented by way of example. However, the following description refers to both of the gripper elements.

The jaws 91 are engagable with the punch 8 and the die 9 respectively. The two jaws 91 are disposed in a horizontal slot 92 in a prismatic body 93 vertically slidable along the guide 64. Each jaw 91 has a projection 94 extending downwards and terminating in a tooth 96. This tooth 96 is directed inside and has a triangular section. Correspondingly, the flange 89, 90 of the punch 8 and the die 9 has a pair of parallel tangential channels 97 which have a triangular section and are capable of being engaged by the two teeth 96.

Furthermore, each jaw 91 has an elastic layer 98 fixed to the projection 94 of the jaw 91 itself by means of two screws or pins 99. The two layers 98 are disposed in different longitudinal positions along the two jaws 91 and are capable of engaging the upper surface of the flange 89, 90 to assist the separation thereof from the jaws 91.

According to a first embodiment of the gripper element 53, 54, each jaw 91 is fixed to a corresponding toothed sector 101 (FIGS. 8 and 8*a*) and is pivoted on a pin 102 of the prismatic body 93. The two sectors 101 are in mutual engagement, and the two pins 102 are parallel to each other. Finally, a linear actuator in the form of a double-acting pneumatic cylinder 103 is pivoted to one side of the body 93, adjacent one of the jaws 91, the rod 104 of the cylinder being connected to a pin 106 fixed to the other jaw 91 and passing through a slot 107 in the body 93.

Usually, the two jaws 91 are separated, as indicated in broken outline in FIG. 5. By rotating the arm 48, 49 (FIG. 2), the gripper elements 53, 54 are brought to the punch 8 and the die 9 in the changeover station 63 of the turret 6 or in the collection station 65 of the magazine 31. Then, by operating the cylinders 69 and 71, the bodies 93 move axially to carry the jaws 91 to the level of the related flange 89, 90, thus bending the two layers 98.

By now operating the pistons 68 of the two gripper elements 53 and 54, the body 93 is moved towards the two punches 8 and the two dies 9 to be taken. Each pair of jaws 91 then surrounds the related flange 89, 90. By now operating the cylinder 103 (FIGS. 7–9), the two jaws 91 grip the flange 89, 90, engaging the teeth 96 in the tangential channels 97. By now operating the cylinders 69 and 71 (FIG. 1) in the reverse sense, the bodies 93 are moved axially to remove the punches 8 and the dies 9 respectively from the respective seats 22, 29, 36, 37.

After having rotated the arms 48 and 49 by 180°, and operated one of the cylinders 68 of the arm 49 in order to adjust its length, each of the punches 8 and dies 9 thus taken can be inserted in the respective seats 22, 29, 36, 37 by operating the cylinder 69 and 71. Finally, the flanges 89, 90 can be released by operating the pneumatic cylinders 103 (FIG. 8). These now rotate the sectors 101 to open the two jaws 91, while the elastic action of the layers 98 assists in the separation of the flanges 89, 90.

In another embodiment of the gripper elements 53, 54, they are formed from two jaws 108 (FIGS. 10 and 11) which are also provided with projections 94 having triangular teeth 96, and elastic layers 98 the same as in FIG. 8. The jaws 108 are instead transversely slidable into two slots 111 in a body 112 which is in turn slidable on the dove-tailed guide 64, analogously to the body 93 (FIG. 7).

The body 112 has a portion 105' (FIG. 11) located between the two slots 111, and to which is fixed a pin 110 perpendicular to the guide 64 and extending in both of the slots 111. Each jaw 108 has a hole 109 which is guided transversely onto the pin 110. The two jaws 108 also have two nuts 113 and 114 threaded in mutually opposite directions. The two nuts 113 and 114 engage two corresponding threaded portions 177 and 178 of a screw 115. The two portions 177, 178 are also threaded in the opposite direction, and the screw 115 is rotated by a reversible servomotor 116.

By rotating the servomotor 116 in one direction, the two portions 177 and 178 of the screw 115 move away from the two nuts 113 and 114, and thus away from the two jaws 108, releasing the flange 89, 90. Rotating the servomotor 116 in the opposite direction moves the screw 115 towards the two nuts 113 and 114, to engage the two teeth 96 of the jaws 108 in the slots 97 in the flange 89, 90.

According to a further embodiment of the gripper elements 53, 54, they are formed from two jaws 117 (FIGS. 12 and 13) pivoted to two parallel pins 118 of a crosspiece 119, connected to the arm 48, 49 in any known way. The crosspiece 119 is further provided with a controllable stop element 120 for the flange 89, 90 of the punch 8 and the die 9. The crosspiece 119 is connected to the support 100, 105 (FIG. 4) which is slidable on the dovetail guide 64 of the rod 66, 67.

An end 121 (FIGS. 12 and 13) of each jaw 117 is capable of engaging a corresponding tangential channel 122 of the flange 89, 90. The channel 122 has a rectangular section, while the end 121 is chamfered in order to assist the insertion into the channel 122, even during the radial movement of the gripper element 53, 54 by the cylinder 68 (FIG. 1). Each tangential channel 122 (FIGS. 12–14) is also associated with an axial channel 123 of triangular section, capable of being engaged by a through-pin 124 which is forced into a hole adjacent the end 121 of the corresponding jaw 117.

Finally, each jaw 117 has another end 126 provided with a pin 127. On the two pins 127 are pivoted, on one side, a pneumatic cylinder 128 and, on the other side, a rod 129 of the related piston. By operating the cylinder 128 to separate the two pins 127, the two jaws 117 close, engaging the tangential channels 122, while the two pins 124 engage the two axial channels 123. Conversely, by operating the cylinder 128 so as to move the two pins 124 together, the two jaws 117 release the flange 89, 90.

The advantages of the gripper elements 53, 54 having a transverse movement of the jaws 91, 108 and 117 are clear, in particular when the two turrets 6 and 7 are coaxial and of equal diameter. In addition, the form of the jaws 91, 108 and 117 and the axial and tangential slots of the flange 89, 90 always ensure the horizontal and vertical alignment of the punch 8 and the die 9 with their related seats 22, 29 and 33, 34. Finally, the form of the jaws 117 enables the removal of the die even in the punching machine of FIG. 4, in which the two turrets 6", 7" are coaxial.

An Axially Moveable Gripper Element for the Punches and Dies

Figure 12:
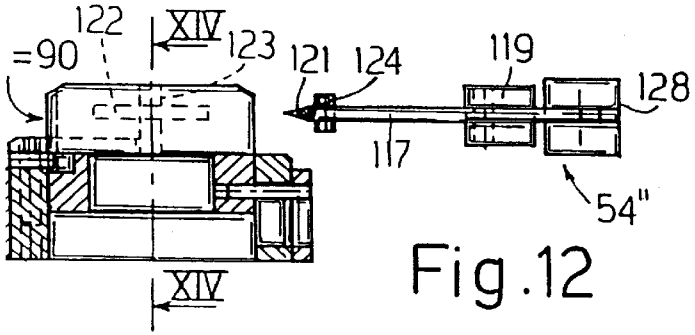
FIG. 12 is a side view, partially in section, of the gripper element of the machine of FIG. 4.
Figure 13:
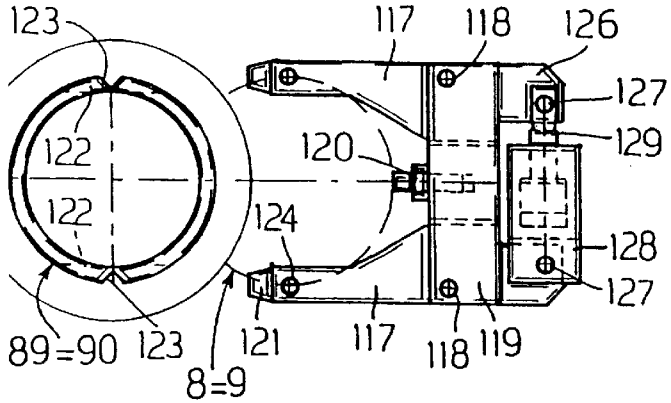
FIG. 13 is a view from above of the gripper element of FIG. 12.
Figure 15:
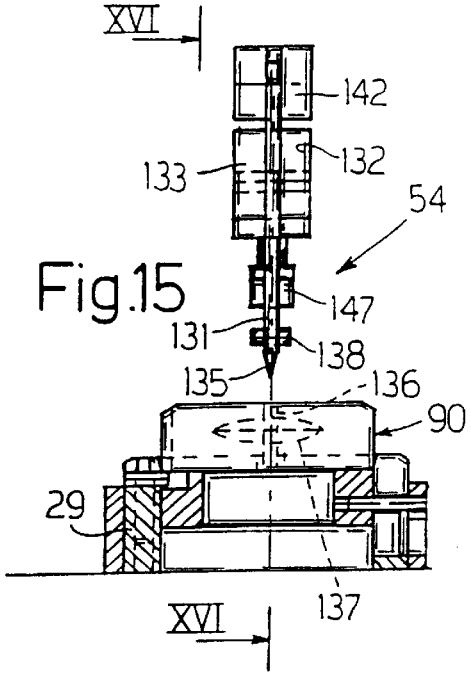
FIG. 15 is a side view, partially in section, of the gripper element of a die according to another embodiment.
Figure 16:
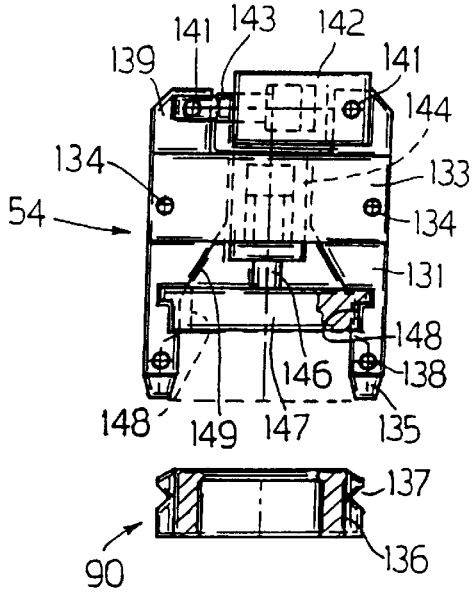
FIG. 16 is a front view, partially in section, of the gripper element taken along the line XVI—XVI of FIG. 15.
Figure 17:
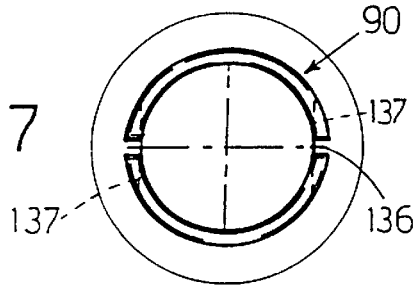
FIG. 17 is a plan view of the die of FIG. 15.
Figure 18:
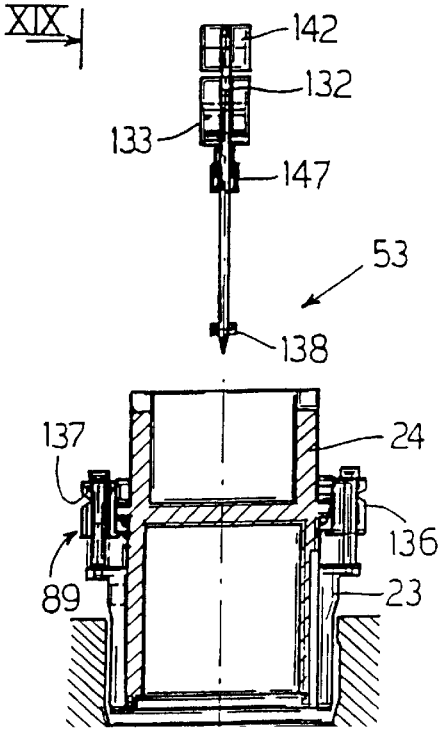
FIG. 18 is a side view, partially in section, of the gripper element of a punch according to the embodiment of FIG. 15.
Figure 19:
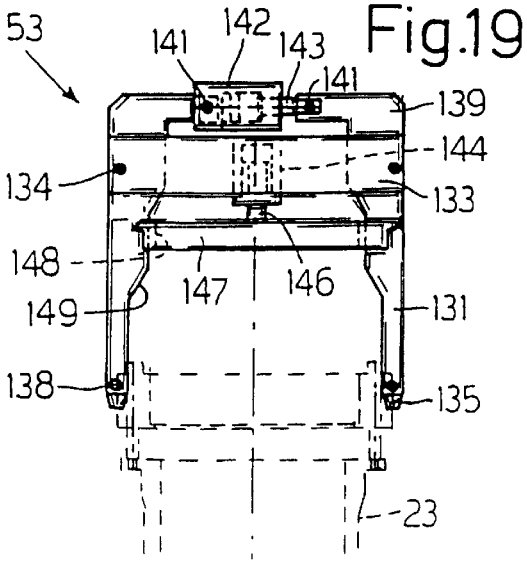
FIG. 19 is a front view, partially in section, of the gripper element taken along the line XIX—XIX of FIG. 18.

According to a further embodiment of the gripper elements 53, 54, they are axially moveable with respect to the punch 8 and the die 9. FIGS. 15 and 16 indicate the gripper element 54 for the flange 90 of a die disposed in the seat 29. FIGS. 18 and 19 indicate the gripper element 53 for the flange 89 of a punch 8, in which the flange 89 is carried by the holder 23. In particular, the gripper element 53, 54 is also in the form of a pair of jaws 131 to engage the punch 8 and the die 9, respectively. The two jaws 131 are located in a vertical slot 132 of a crosspiece 133, and are pivoted on two pins 134 of the crosspiece 133. This is connected to the support 100, 105 of the arm 48, 49 (FIG. 1) analogously to the crosspiece 119 (FIGS. 12 and 13). Alternatively, the crosspiece 133 can be provided with the handle and be connected to the support 174 (FIG. 6) of the arm 145.

An end 135 of each jaw 131 is engagable in a corresponding axial channel 136 of the flange 89. The two channels 136 are diametrically opposed and have a rectangular section, while the end 135 of the jaws 131 is chamfered in order to assist the insertion in the channel 136. Each axial channel 136 is also associated with an axial tangential channel 137 having a triangular section, capable of being engaged by a through-pin 138 which is forced into a hole in the end 135 of the corresponding jaw 131.

Each jaw 131 is further provided with another end 139 provided with a pin 141. On the two pins 141 are pivoted, on one side, a pneumatic cylinder 142 and, on the other side, the related rod 143. The crosspiece 133 carries another pneumatic actuator formed from a cylinder 144 and a rod 146 which is firmly connected to a moveable crosspiece 147. This has two slots 148 parallel to the rod 146, in each of which a cam edge 149 of one of the jaws 131 is engaged.

Usually, the gripper element 53, 54 is located below the flange 89, 90, the channels 136 of which being located on the same vertical plane as the jaws 131. The actuator 142, 143 holds the jaws 131 open, while the actuator 144, 146 holds the crosspiece 147 in a high position. By lowering the crosspiece 133, the two jaws 131 carry the pins 138 to the level of the tangential channels 137.

By now operating the cylinder 142 in such a way as to separate the two pins 141, the two jaws 131 close, engaging in the axial channels 136. The complete closure of the jaws 131 is, however, temporarily prevented by the crosspiece 147. Immediately after the start of this engagement, a sensor, not indicated in the drawings, is activated, which sensor controls the operation of the cylinder 144 in such a way as to lower the crosspiece 147. This now unlocks the jaws 131 which are able to close completely so that the two pins 138 engage the two tangential channels 137, thus locking the flange 89, 90. The crosspiece 133 can now be raised to remove the punch 8 or the die 9 from the respective seat.

In order to insert the punch 8 or the die 9 into the respective seat, the reverse movements to those described above are effected. In particular, the cylinder 144 is first of all operated so as to release the pins 138 from the channels 137. Lowering the cross piece 147 also engages the holder 23 of the punch 8, or the flange 90 of the die 9, so that they do not remain connected to the pins 138 of the jaws 131. Finally, the cylinder 142 is operated in order to move the two pins 141 closer, so that the jaws 131 open, releasing the flange 89, 90.

The advantages of the gripper elements 53, 54 having axially moveable jaws 131, with respect to the known jaws, are clear. In particular, the form of the jaws 131 and the pin 138 always ensures the horizontal and vertical alignment of the punch 8 and the die 9 with the related seats 22, 29; 33, 34. In addition, the actuator 144, 146 of the crosspiece 147, on the one hand, ensures that the flange 89, 90 is locked only if the jaws 131 are aligned with the channels 137 and, on the other hand, avoids the flange 89 remaining connected to the jaws 131 when they are opened.

A Radially Moveable Gripper Element for Punches and Dies

Figure 20:
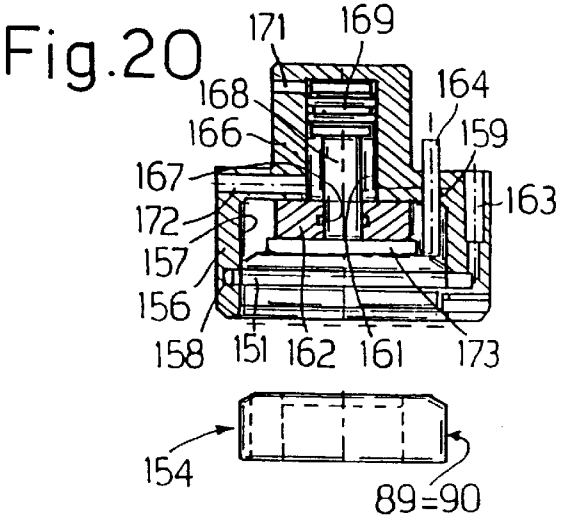
FIG. 20 is a lateral section of a gripper element according to another embodiment.
Figure 21:
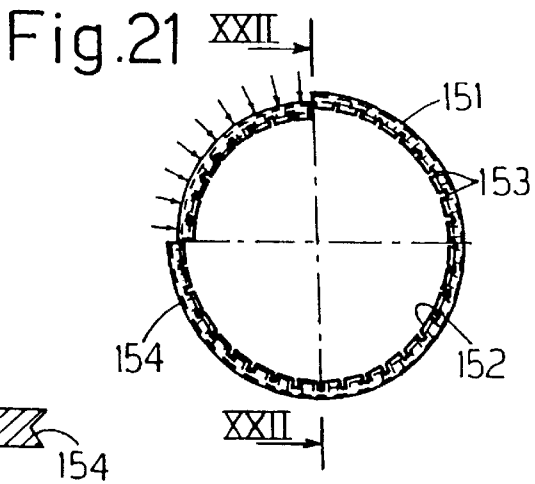
FIG. 21 is a plan view of a component of the gripper element of FIG. 20, on an enlarged scale and with portions in different operative positions.
Figure 22:
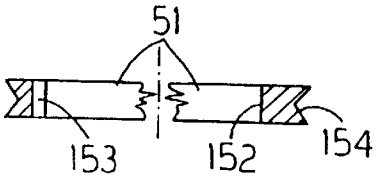
FIG. 22 is a partial section taken on the line XXII—XXII of FIG. 21, on a further enlarged scale.

According to a further embodiment of the gripper elements 53, 54, they have an element 151 (FIGS. 20–22) radially movable with respect to the punch 8 and the die 9. In particular, the element 151 is formed from an elastic ring, for example, made from elastomeric material, having an inner surface 152 provided with a series of axial slots 153 extending for the entire height of the ring 151 and disposed at a predetermined angular distance from each other.

The inner surface 152 is capable of engaging the side surface of the flange 89, 90 of the punch 8 or the die 9. The ring 151 is further provided with an outer surface 154 in the form of two truncated cones joined by the minor base. The ring 151 is carried by a body 156 which can be carried by each end of the two arms 48 and 49 (FIG. 1), in any known way.

The body 156 has a reversed cup shape and includes a side wall 157, the inner surface of which having an annular channel 158 in which the ring 151 is inserted. The body 156 also includes a flat wall 159, the central zone of which is provided with a hole 161 closed by a flange 162. A duct 163 is formed in the wall 157, which opens into the channel 158 and is capable of being supplied with compressed air. Another duct 164 is inserted in the flat wall 159, this also capable of being supplied with compressed air.

The wall 159 is integral with a double-acting pneumatic cylinder 166 which is closed at its base by the flange 162. A rod 168 of a piston 169 is sealingly slidable in a hole 167 in the flange 162. This can be operated downwards through a first duct 171 formed in the cylinder 166, or upwards through a second conduit 172 formed in the wall 159. The rod 168 is connected with a flange 173 capable of acting on the upper surface of the flange 89, 90 of the punch 8 or the die 9.

Usually, the piston 169 is in a high position and the ring 151 is stretched and rests against the side wall of the channel 158. The cup-shape body 156 is initially lowered, disposing the ring 151 around the lateral surface of the flange 89, 90 of the punch 8 or the die 9. Then, compressed air is introduced into the duct 163 so that it presses radially on the surface 154 of the ring 151. By virtue of the slots 152, the ring 151 reduces its internal diameter, locking the flange 89, 90. The body 156 is now moved upwards, removing the punch 8 or the die 9 from its seat.

In order to insert the punch 8 or the die 9 in the new seat, the flange 89, 90 of which is locked by the ring 151, the body 156 is first lowered. Then, compressed air is introduced into the duct 164 in such a way as to press on the inner surface 152 of the ring 151. This is then distended again to unlock the flange 89, 90.

Compressed air is now introduced into the duct 171 so as to move the piston 169 downwards. This then carries the flange 173 to press on the upper surface of the flange 89, 90, so that it does not remain attached to the ring 151. Finally, the body 156 is again carried upwards and compressed air introduced to the duct 172 so that the piston 169 is also returned upwards to rest.

Figure 14:
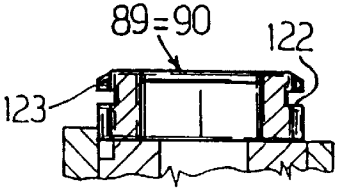
FIG. 14 is a partial section taken along the line XIV—XIV of FIG. 12.

It is clear that the gripper element according to FIGS. 13–15 has a significantly reduced number of moving parts, making manufacture simple and economical.

It is clear that various modifications and improvements can be introduced to the gripper elements of FIGS. 7–22 without by this departing from the ambit of the associated claims.

What is claimed is:

1. An orientation device, comprising:

a magazine operatively associated with a series of punches and dies for holding said punches and dies; and a changeover device operatively associated with said magazine for changing over at least one of said punches and dies between a changeover station and said magazine;

wherein at least one of said punches and dies rotates around a longitudinal axis of said at least one of said punches and dies.

2. The orientation device as claimed in claim 1, wherein said orientation device is disposed on said magazine.

3. The orientation device as claimed in claim 1, wherein said orientation device is disposed on said changeover device.

4. In a punching machine, the improvements comprising:

a magazine operatively associated with a series of punches and dies for holding said punches and dies;

a changeover device operatively associated with said magazine for changing over at least one of said punches and dies between a changeover station and said magazine; and an orientation device operatively associated with one of said magazine and changeover device to rotate at least one of said punches and dies respectively around a longitudinal axis of said at least one of said punches and dies.

* * * * *